US006119605A

United States Patent [19]

Agee

[11] Patent Number: 6,119,605

[45] **Date of Patent: *Sep. 19, 2000**

[54] HEIGHT ADJUSTABLE TABLE WITH COUNTERBALANCE SPRING AND LOAD BALANCE INDICATOR

[75] Inventor: William M. Agee, Pineville, La.

[73] Assignee: Baker Manufacturing Company, Pineville, La.

[ * ] Notice: This patent is subject to a terminal disclaimer.

[21] Appl. No.: 09/328,717

[22] Filed: Jun. 9, 1999

[51] Int. Cl.[7] ..... A47B 9/00

[52] U.S. Cl. ..... 108/147; 248/162.1

[58] Field of Search ..... 108/147, 146, 108/144.11, 147.19; 248/162.1, 414, 422, 188.5

[56] References Cited

U.S. PATENT DOCUMENTS

| | | | |
|---|---|---|---|
| 544,836 | 8/1895 | Vetter . | |
| 2,982,050 | 5/1961 | May . | |
| 3,140,559 | 7/1964 | Grow et al. | 108/147 X |
| 3,213,809 | 10/1965 | Kritske . | |
| 3,273,517 | 9/1966 | Amthor, Jr. et al. . | |
| 3,364,881 | 1/1968 | Kooi . | |
| 3,638,584 | 2/1972 | Cisler . | |
| 3,908,560 | 9/1975 | Horner . | |
| 4,130,069 | 12/1978 | Evans et al. . | |
| 4,360,180 | 11/1982 | Bruneau | 108/146 X |
| 4,619,208 | 10/1986 | Kurrasch . | |
| 4,751,884 | 6/1988 | Ball . | |
| 5,289,782 | 3/1994 | Rizzi et al. . | |
| 5,322,025 | 6/1994 | Sherman et al. . | |
| 5,339,750 | 8/1994 | Smies . | |
| 5,400,721 | 3/1995 | Greene . | |
| 5,408,940 | 4/1995 | Winchell . | |
| 5,598,788 | 2/1997 | Jonker | 108/147 |
| 5,797,331 | 8/1998 | Watt | 108/146 |

*Primary Examiner*—Janet M. Wilkens
*Attorney, Agent, or Firm*—Garvey, Smith, Nehrbass & Doody, LLC

[57] ABSTRACT

An adjustable height table has a base with spaced apart side portions, each side having a foot that engages the floor or like support surface. Each side portion includes a lower non-elevating part and an upper elevating lifts. A gear mechanism interfaces the upper and lower parts. A counterbalance spring can be used to counterbalance loads of different amounts such as when different objects are supported by the table work surface. A load indicator indicates to a user whether or not the counterbalance mechanism is in balance with a load placed on the work surface.

30 Claims, 12 Drawing Sheets

HEIGHT ADJUSTABLE TABLE WITH COUNTERBALANCE SPRING AND LOAD BALANCE INDICATOR

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to adjustable tables, more particularly, tables having a work surface that can carry heavy objects and yet be adjusted into multiple elevational positions. Even more particularly, the present invention relates to an improved height adjustable table having a spring counterbalance that enables easy height adjustment, and a load balance indicator that indicates to a user if the spring is over wound, or if too much weight is placed on the table, even when supporting weighted objects such as computers, monitors and the like.

2. General Background of the Invention

Adjustable tables have been in use for many years. There are several adjustable height tables that are commercially available. Several of these adjustable height tables were patented as drafting tables. Some were sold under the trademark Hamilton. For example, U.S. Pat. 3,273,517 issued to Amthor, entitled "Drafting Table" and assigned to Hamilton Mfg. Co., discloses a table having elevating sides that raise and lower a work surface and wherein a counter-balanced spring (see FIG. 11) can be adjusted to compensate for different loads such as various weights of the drafting board and the objects mounted thereon. U.S. Pat. 3,273,517 is incorporated herein by reference.

U.S. Pat. 3,638,584 shows an adjustable height table that purports to be a drafting table construction.

An example of a height adjustable table is shown in the Winchell U.S. Patent 5,408,940. In the Winchell patent, a work table is cantilevered from posts supported for vertical motion inside columns from a base. A drive connected between the work table and the base changes the height of the work table and is located between the columns and posts. Each post carries a rack that engages with a pinion supported by a column for rotation about a common axis. A rigid shaft interconnects two pinions and prevents relative pinion rotation. A stabilizing structure in each column interacts with the post to maintain engagement between the rack and pinion structure and maintains the work table in a horizontal position during adjustment and use.

U.S. Pat. No. 5,289,782 issued to John Rizzi et al. discloses an adjustable height table having a top that can be vertically adjusted to various heights by a pair of telescoping legs and a counter-balanced weight mechanism which includes a weight box and weights that can be easily added or removed by the user depending on the weight carried by the table top. A locking mechanism includes a spring urged threaded half nut and a stationary threaded rod that enables the table top to be locked in place one a desired height is achieved.

An improved load compensator for a spring counter weighting mechanism is disclosed in U.S. Pat. 5,400,721. In the '721 patent, a small cam provides a constant counter-weight force. The cam provides a constant torque to a drum on which are wound cables for exerting a constant counter weighting force. A manually operable device for altering the relative radial positions of the cam and drum varies the mount of the constant counter weighting force. The cam is rotated with respect to the drum by a spur gear fitted within a ring gear fixed to the drum and rotated by a knob connected to an axle carrying a pinion gear engaging the spur gear. The spiral surface can be effectively reconfigured with respect to a portion of the cable fitting there around.

Other examples of adjustable height tables include U.S. Pat. Nos. 544,836; 2,982,050; 2,982,050; 3,213,809; 3,364,881; 3,908,560; 4,130,069; 4,619,208; 4,751,884; 5,322,025; and 5,339,750.

A release mechanism is provided for enabling a user to disengage a locking mechanism that holds the work platform in a particular position. The release mechanism slowly lowers the table if it is overloaded with too much weight. In a situation where the counter balance spring has been over wound, the release mechanism includes a brake that slowly elevates the table gradually releasing the energy stored in the counter balanced spring.

The present invention provides an improved adjustable height table with improved brake mechanism for safely and easily indicating to a user when it is overloaded with wright or when its counter balance spring has been over wound.

One of the primary uses for adjustable height tables is the support of a heavy object such as a computer and/or monitor at a comfortable elevation for the user. Because computers and monitors are relatively heavy, a problem exists when the table position is to be changed to a higher or lower elevational position, such as when the user chooses to stand or to sit. In such a situation, adjustable height tables can drop too quickly The weighted table top of the table can cause injury if it is loaded with a heavy object such as a monitor, computer or the like and the user adjusts without proper counterbalance.

BRIEF SUMMARY OF THE INVENTION

The present invention provides an adjustable height table that has a base with feet and spaced apart sides. The sides include non-elevating lower parts and elevating upper parts.

A gear train enables the upper and lower parts to telescope, one part elevating with respect to the other. The gear train can include a rack and pinion gear arrangement and a counterbalance spring that enables the table to carry different objects that vary in weight.

The adjustable counterbalance mechanism aids a user to raise or lower the elevating portion (for example table) with respect to the base. The counterbalance mechanism is adjustable to compensate for different weight objects that are placed upon the work surface by a user.

A locking mechanism holds the elevating portion in a fixed position. The locking mechanism includes a release for releasing the elevating portions so that they can be elevated or lowered by a user to a selected desired elevational position.

An indicator visually displays to a user an indication of whether or not the counterbalance mechanism is balanced with a load that is placed on the work surface.

The indicator preferably enables a user to determine whether the counterbalanced mechanism is either over or under balanced for the load that is placed on the work surface.

The indicator can preferably be in the form of a pointer that visually displays an indication of the extent to which the counterbalance mechanism is out of balance.

The apparatus can include a brake mechanism that interfaces with one of the elevating portions of the table base to prevent rapid movement of the table when the counterbalance is out of balance.

The indicator indicates to a user that too much weight is on the work surface, for example by displaying a plus or positive indication. The indicator also indicates to a user whether the counterbalance mechanism is overbalanced for the weight on the table surface, by displaying a minus indication to a user. The indicator can thus be in the form of a pointer that moves between a plus and a minus indication with a balanced condition being shown when the pointer is spaced equally in between the plus and minus sign.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
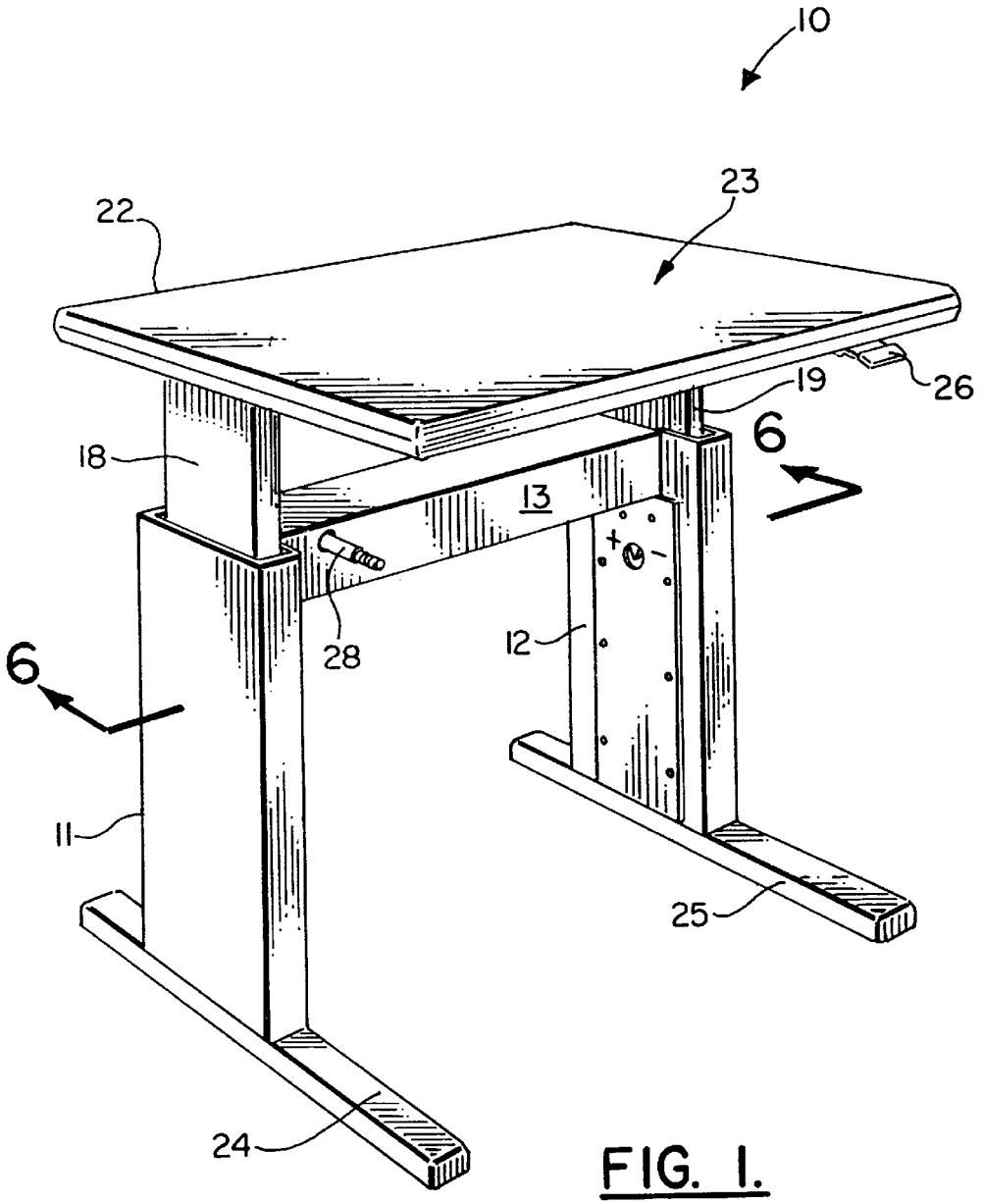
FIG. 1 is a perspective view of the preferred embodiment of the apparatus of the present invention.
Figure 5:
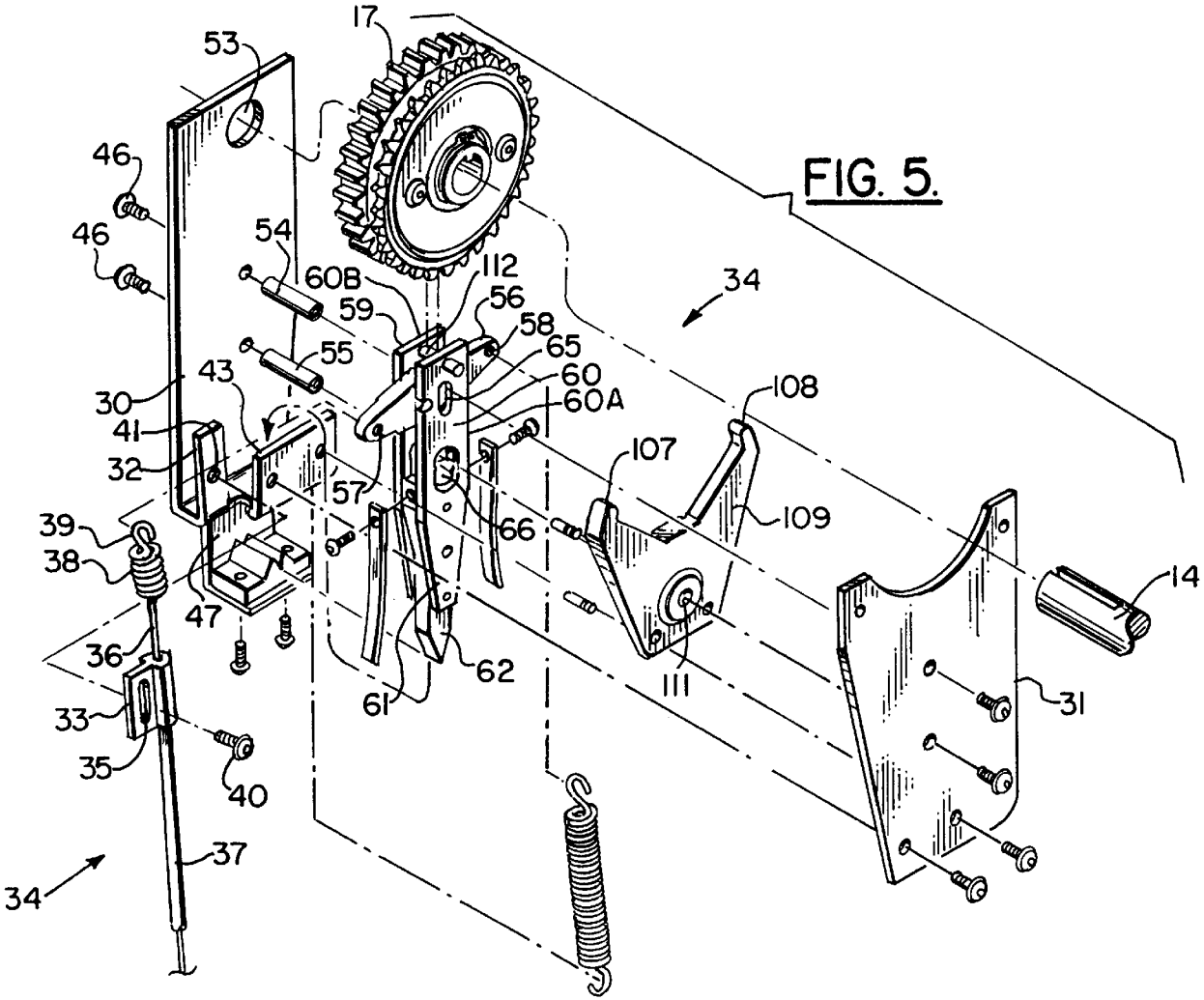
FIG. 5 is a partial exploded view of the preferred embodiment of the apparatus of the present invention.
Figure 6:
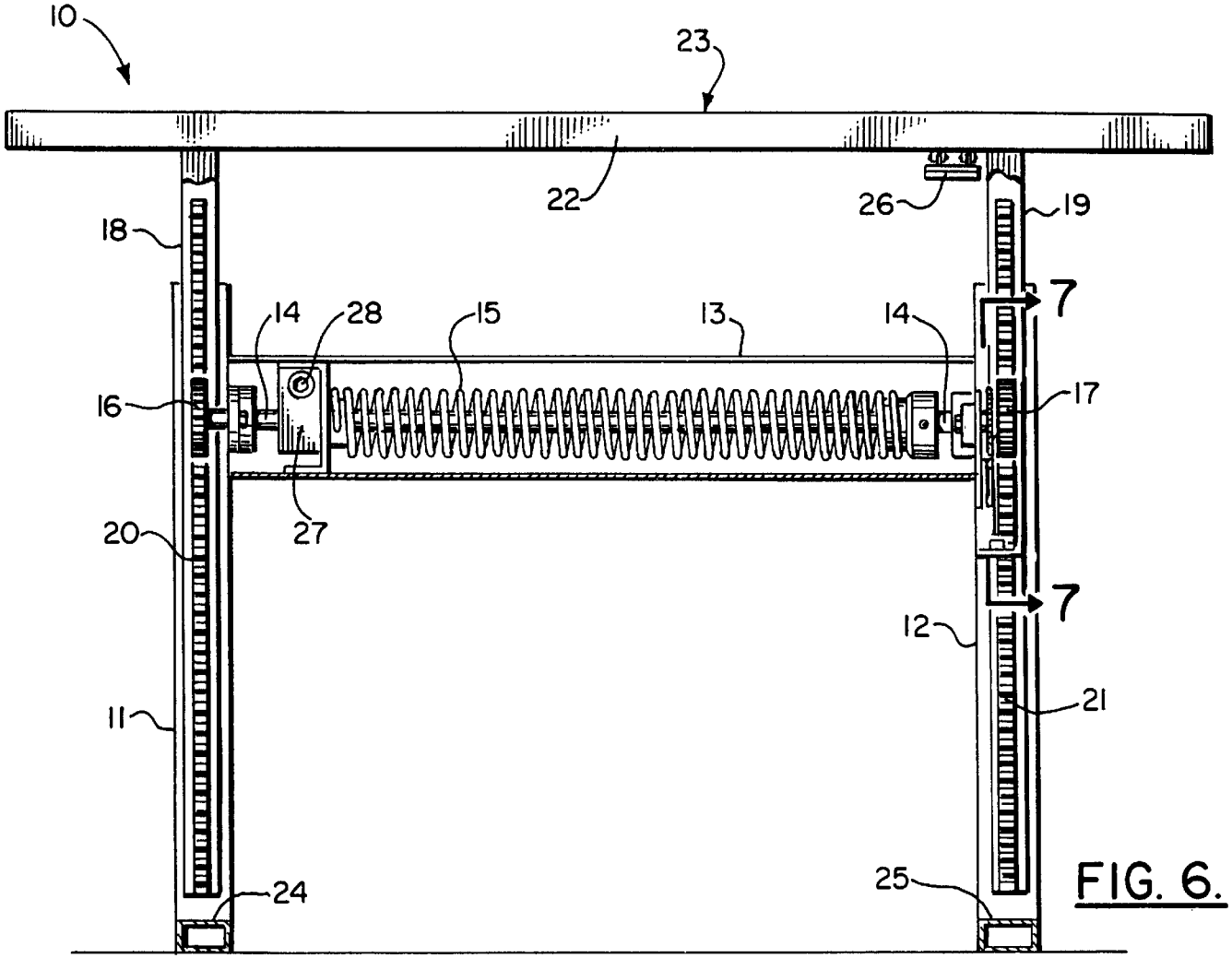
FIG. 6 is an elevational view of the preferred embodiment of the apparatus of the present invention.

FIGS. 1–6 show the preferred embodiment of the apparatus of the present invention designated generally by the numeral 10 in FIGS. 1 and 6. Adjustable height table 10 includes a pair of spaced apart base side portions 11, 12 supported upon respective spaced apart feet 24, 25. Cross member 13 stands between base side portions 11, 12. A rotating shaft 14 is mounted on cross member 13 and spans between a pair of spaced apart pinion gears 16, 17. Each of the pinion gears 16, 17 engages a respective toothed rack 20, 21 on an elevating lift, 18, 19. The base sides 11, 12 can be in the form of structural channel members that slidably support lifts 18, 19 in telescope fashion. A counter balanced spring 15 provides a counter balance force to the shaft 14 and pinion gears 16, 17 for compensating for variations in weight placed on upper work surface 23 of table top 22. Such a counter balanced spring 15 is known in the art for use with height adjustable tables. Such counterbalance spring tables have been commercially sold by Hamilton as drafting tables since about the 1960s.

Counter balance spring 15 can be provided with an adjustment mechanism such as a worm gear spring adjuster 27 having a shaft 28 that can be fitted with a power driver such as a drill, impact driver, socket wrench or the like when adjusting spring 15.

In FIGS. 2–5, there is seen a brake mechanism that can be used to slow upward or downward movement of the table top 22 if it is either overloaded with too much weight in the form of articles placed on upper work surface 23, or if spring 15 is over wound. In the first situation, the brake mechanism prevents a rapid descent of the upper work surface 23.

If the spring 15 is over wound, the brake mechanism prevents rapid ascent of the table top 22. Such a situation can occur for example if a heavy weighted object (such as a computer and its CRT) are initially placed on the table 22, the counter balance spring 15 set to compensate for the heavy computer, and the heavy objects later removal.

A computer and a large CRT screen can weigh as much as 100–150 lbs., for example. If the counter balance spring 15 is set to compensate for this 100–150 lbs. weight and the weights are later removed, the counter balance spring 15 is now over-wound so that the table top 23 would ordinarily travel upwardly at a rapid rate if a user attempts to adjust the elevational position of table 22. However, in either situation, the present invention slows such movement so that the user is provided with a visual indication load balance. The user can see that the spring 15 is not balanced and thus make adjustment using shaft 28 before changing elevational position of table top 22.

Figure 7:
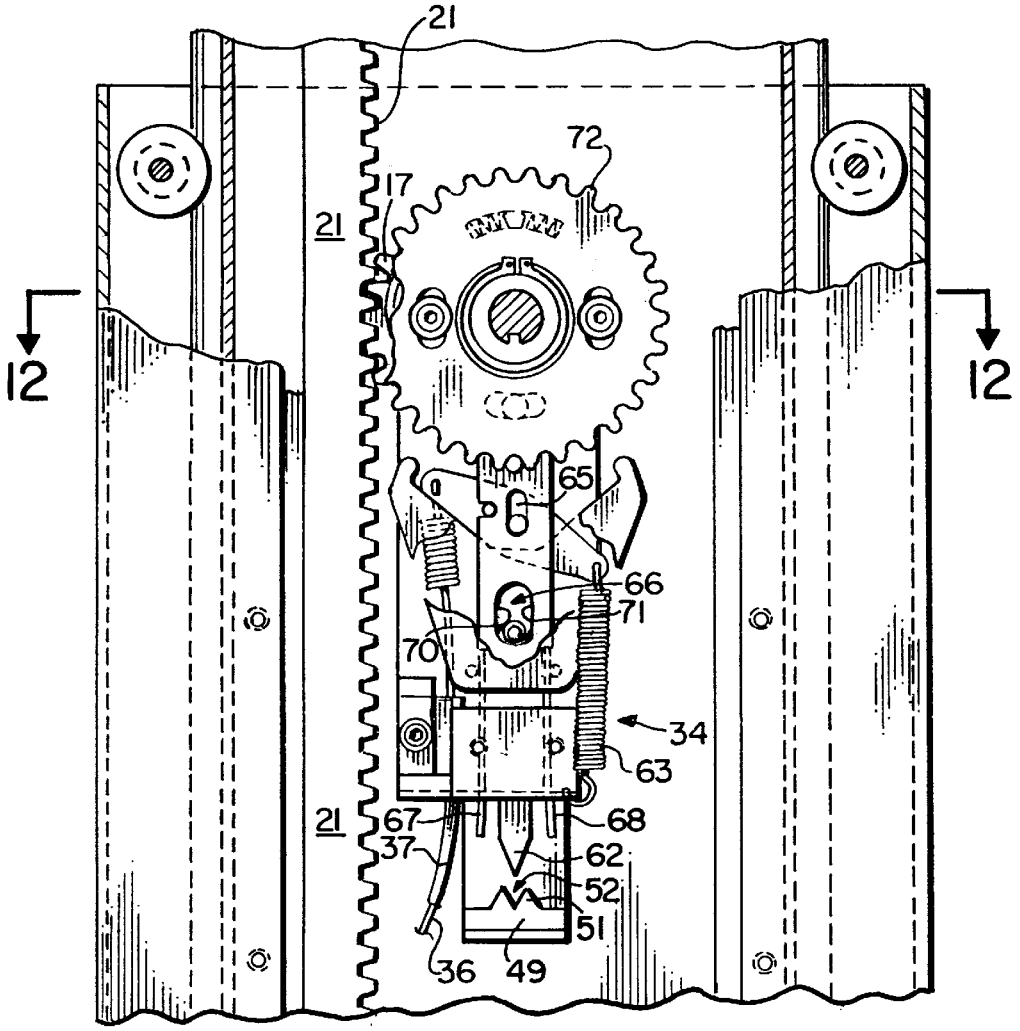
FIGS. 7–7A are elevational views of the brake portion of the preferred embodiment of the apparatus of the present invention shown in a balanced condition.
Figure 12:
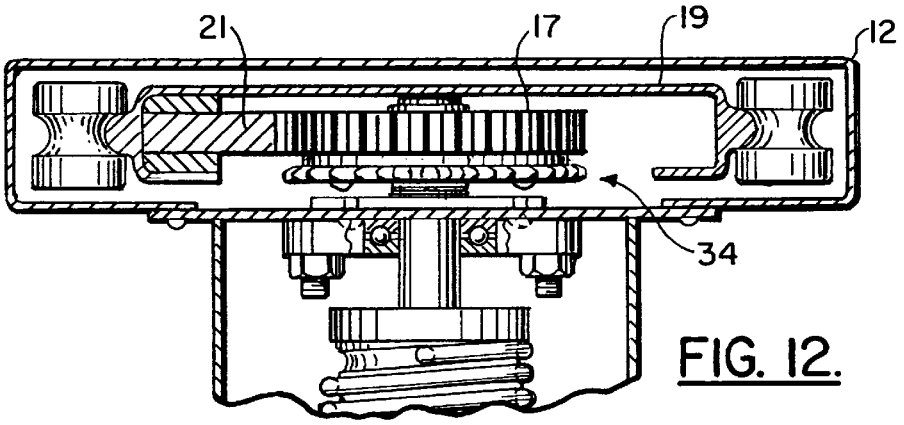
FIG. 12 is a sectional view taken along lines 12—12 of FIG. 7.

In FIGS. 6–7 and 12, one of the lifts 19 is shown mounted in side 12. The rack 21 of lift 19 engages pinon gear 17 as shown in FIGS. 6–7. A release paddle 26 is mounted on the underside for example, of table top 22. The release paddle 26 operates a retractable cable to pull or push the actuator arm 56 of brake mechanism 34 as it is generally indicated in FIG. 7. If the spring 15 is over wound, or if too much weight is on upper work surface 23, the brake mechanism 34 locks and only allows very slow upward or very slow downward movement of the table top 22.

In FIGS. 4–5 and 7–12, the braking mechanism 34 has a rear plate 30 and a front plate 31. The rear plate 30 includes a narrow vertical flange 32 to which is attached cable support 33. Cable support 33 has a slot 35 through which a bolted connection 40 can be placed for attaching the cable support 33 to narrow vertical flange 32. Cable 36 is contained within sheath 37. The cable 36 attaches at one end to spring 38 having hook 39. The other end of cable 36 attaches to paddle 26 that enables a user to pull cable 36 by depressing paddle 26. Bolted connection 40 bolts cable support 33 to internally threaded opening 41 of vertical flange 32.

Rear plate 30 has a lower horizontal section 42 that supports wide vertical flange 43. The vertical flange 43 has a pair of spaced apart threaded openings 44 that receive bolts 45 for attaching front plate 31 to wide vertical flange 43.

Rear plate 30 carries a pair of internally threaded shafts 54, 55. Shafts 54, 55 can be bolted to rear plate 31 using bolts 46. Bolts 46 can also be used to fasten front plate 31 to shafts 54, 55. Plate 30 has a lower section 47 with load indicator platform 48 that supports load indicator 49. Load indicator 49 includes a pair of spaced apart projections 50, 51 having a gap 52 therebetween. When pointer 62 registers directly in between projections 50, 51, a balanced condition is achieved. This balanced condition indicates to a user that the load placed upon the table top 22 upper work surface 23 is properly balanced by the counter balance spring 19.

The rear plate 30 has an opening 53 for shaft 14. Pinion gears 16, 17 are mounted on shaft 14. Actuator arm 56 is mounted in between the plates 60A and 60B of locking member 60. Openings 57, 58 at the opposing end portions of actuator arm 56 receive a pair of springs. Spring 38 attaches at hook 39 to opening 57. Spring 63 attaches to opening 58.

Figure 8:
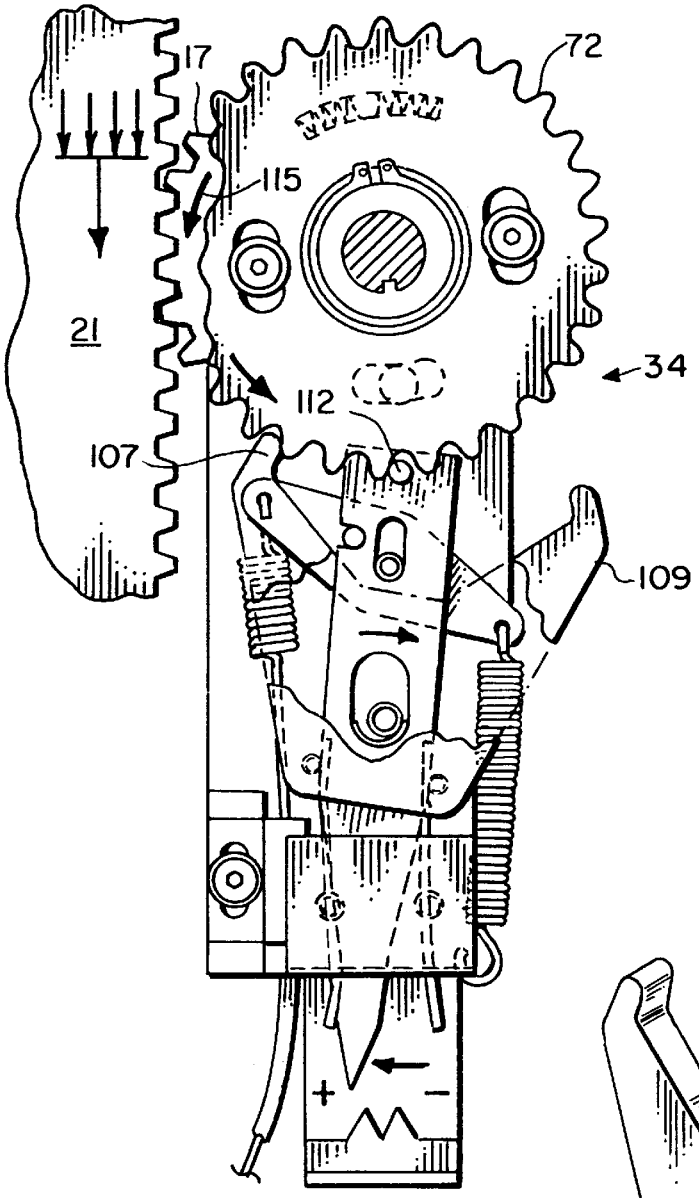
FIG. 8 is a partial elevational view of the preferred embodiment of the apparatus of the present invention shown in an overloaded table condition.
Figure 13:
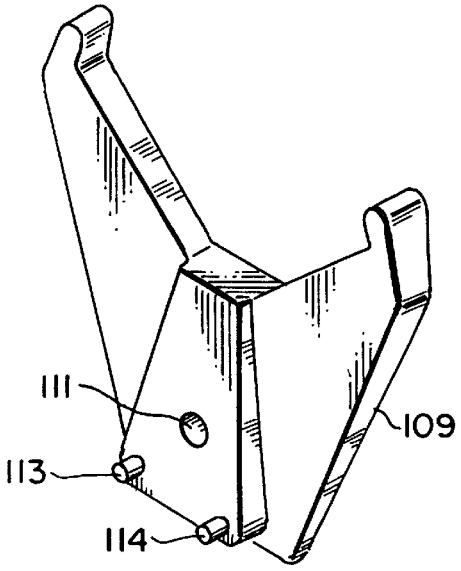
FIG. 13 is a fragmentary perspective view of the preferred embodiment of the apparatus of the present invention showing the yoke portion of the brake mechanism.

The locking member 60 has an upper end 59 and a lower end 61. Spring 63 pulls on the actuator arm 56 to hold the locking member 60 in a locking position. In this locking position, locking pin 112 engages the teeth of both pinion gear 17 and brake sprocket 72. Cam shaft 64 forms a connection with actuator arm 56 on one side of plates 60A, 60B as shown in FIGS. 5 and 8.

The locking member 60 has an upper vertical slot 65 and a central opening 66. The locking member 60 also carries a pair of leaf springs 67, 68 that engage a lower slot 69 in horizontal section 42 of rear plate 30. The sides of opening 66 define stops 70, 71 that limit movement of the locking member 60.

In FIGS. 2–5 there can be seen brake sprocket 72 that is affixed to the pinion gear 17 with a plurality of friction discs 77–80 in between. This construction is shown best in FIGS. 2 and 3. A brake or dampening for rotation of a pinion gear 17 is provided when the table top 22 is overloaded, or in a situation wherein the counterbalance spring 15 is over wound. In such a situation, the plurality of discs 77–80 frictionally engage so that the relative rotation between brake sprocket 72 and the pinion gear 17 is slowed to a single revolution every few seconds.

Figure 2:
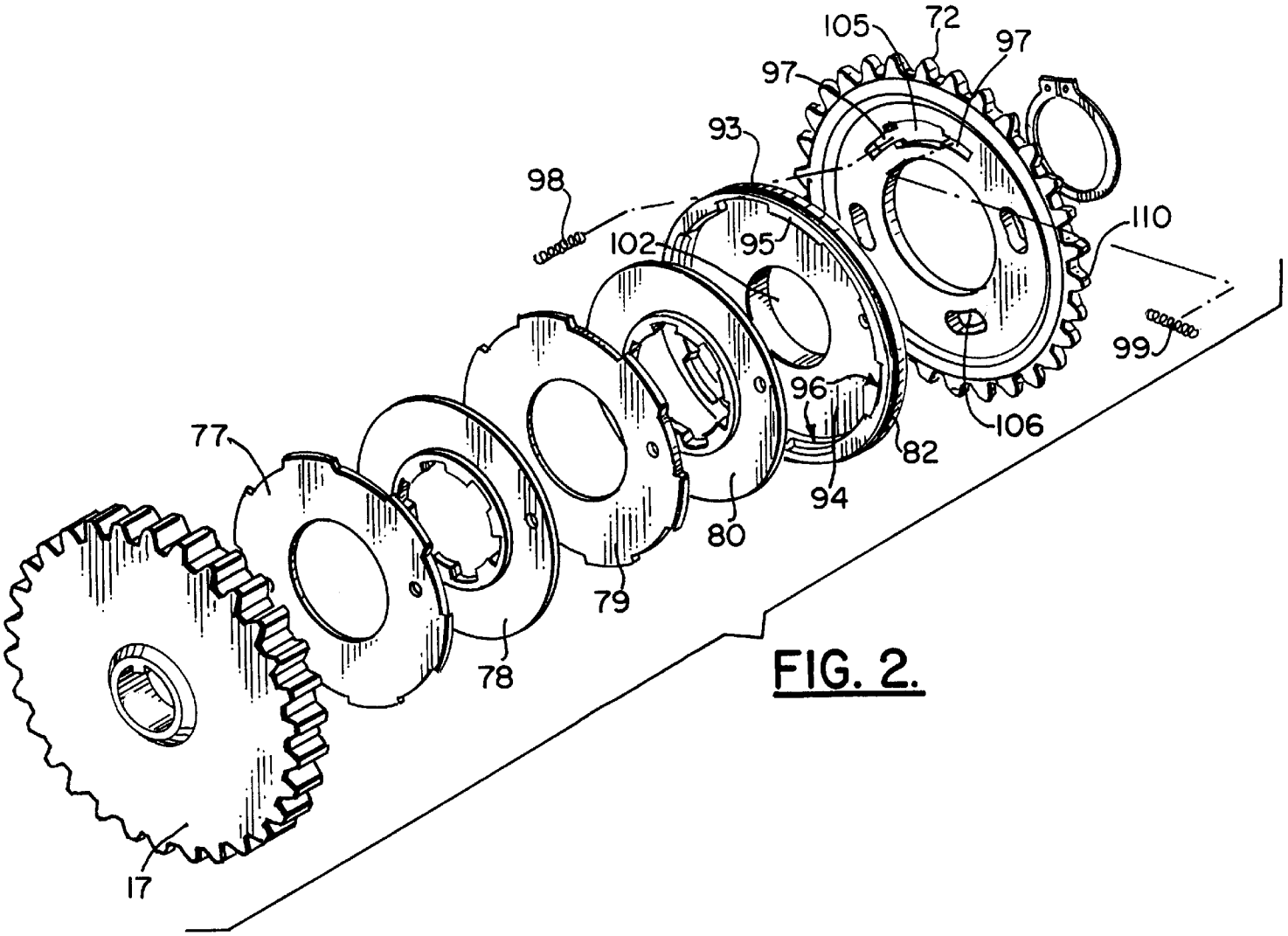
FIG. 2 is a partial perspective exploded view of the preferred embodiment of the apparatus of the present invention.
Figure 3:
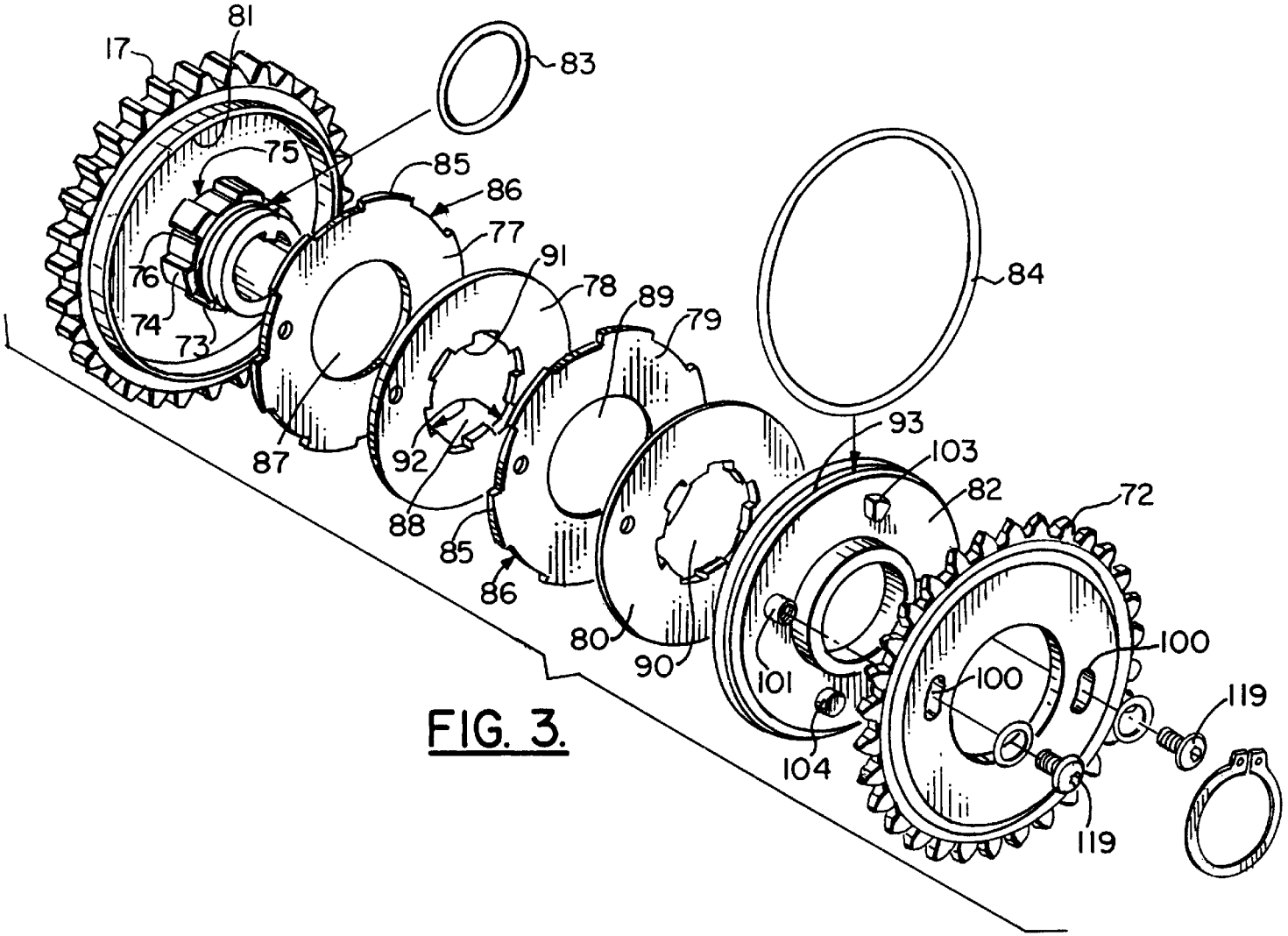
FIG. 3 is another partial perspective exploded view of the preferred embodiment of the apparatus of the present invention.
Figure 4:
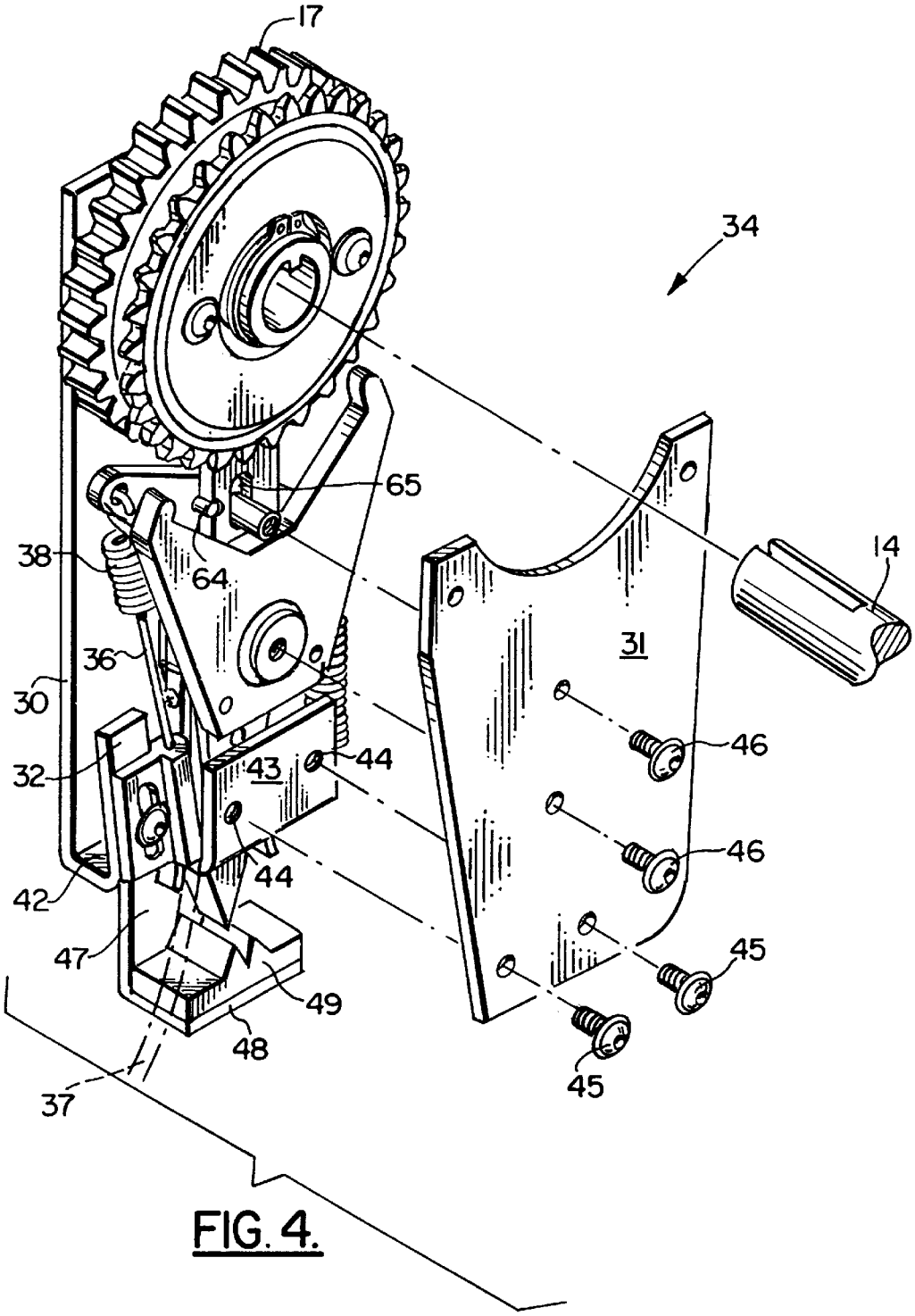
FIG. 4 is a partial perspective exploded view of the preferred embodiment of the apparatus of the present invention.

In FIGS. 2 and 3, pinion gear 17 has an annular shoulder 81 at the periphery of the gear 17 and an inner splined annular hub 73. The splined hub 73 has radially extending projections 74 that are spaced circumferentially apart with slots 75 therebetween as shown in FIG. 3. The hub 73 can also be provided with annular groove 76 that accepts o-ring 83 to form a seal. The plurality of discs 77–80 nest on hub 74.

The discs 77 and 79 have generally circular openings 87, 89 respectively. Conversely, the discs 78, 80 have splined openings 88, 90. The splined openings 88, 90 are shaped to fit and conform to the splined hub 74. The discs 78 and 80 rotate with hub 74 and pinion gear 17.

The discs 77, 79 have circular openings 87, 89 respectively, but provide splined peripheral portions. The disc 77 is provided with a plurality of radially extending peripheral projections 85 that alternate with a plurality of peripheral recesses 86. Likewise, the disc 79 has a plurality of radially extending peripheral projections 85 that alternate with a plurality of peripheral recesses 86.

Disc housing cover 82 provides projections and recesses that correspond in size and shape to the projections 85 and recesses 86 of the discs 77 and 79. The discs 77 and 79 fit the peripheral projections 95 and the peripheral recesses 96 of disc housing cover 82. The projections 95 and recesses 96 are carried by an annular shoulder 93 portion of disc housing cover 82.

Disc housing cover 92 is comprised of a flat plate portion 95 having a central circular opening 102 and annular shoulder 93. The disc housing cover 82 provides a plurality of projecting portions 103, 104 that fit recesses 105, 106 of brake sprocket 72. The recess 105 includes a pair of slots 97 that each carry a spring 98, 99. The springs 98, 99 engage the closed end portions of the slots 97 and also engage opposing sides of the projecting portion 103.

Assembly bolts 119 extend through slots 100 of brake sprocket 72 and engage cylindrical receptacles 101 of disc housing cover 82. This construction enables some "play" between brake sprocket 72 and disc housing cover 82 so that when the teeth of sprocket 72 engage a projecting portion 107, 108 of yoke 109, there can be some play to enable the projection 107 or 108 to fully engage a space in between a pair of teeth 110 of brake sprocket 72.

Yoke 109 fastens at opening 111 to shaft 55. When the table is overloaded, torque is transmitted from pinion gear 17 to pin 112. The pin 112 is mounted to plates 60A, 60B of indicator 60. The pin 112 engages both pinion gear 17 and brake sprocket 72. Thus, torque applied by pinion gear 17 to pin 112 causes locking member 60 to rotate about shaft 55. As shown in FIGS. 8, 9, 10 and 11, an out of balance condition can result from an over weighted table 22 or an over wound spring 15.

Figure 9:
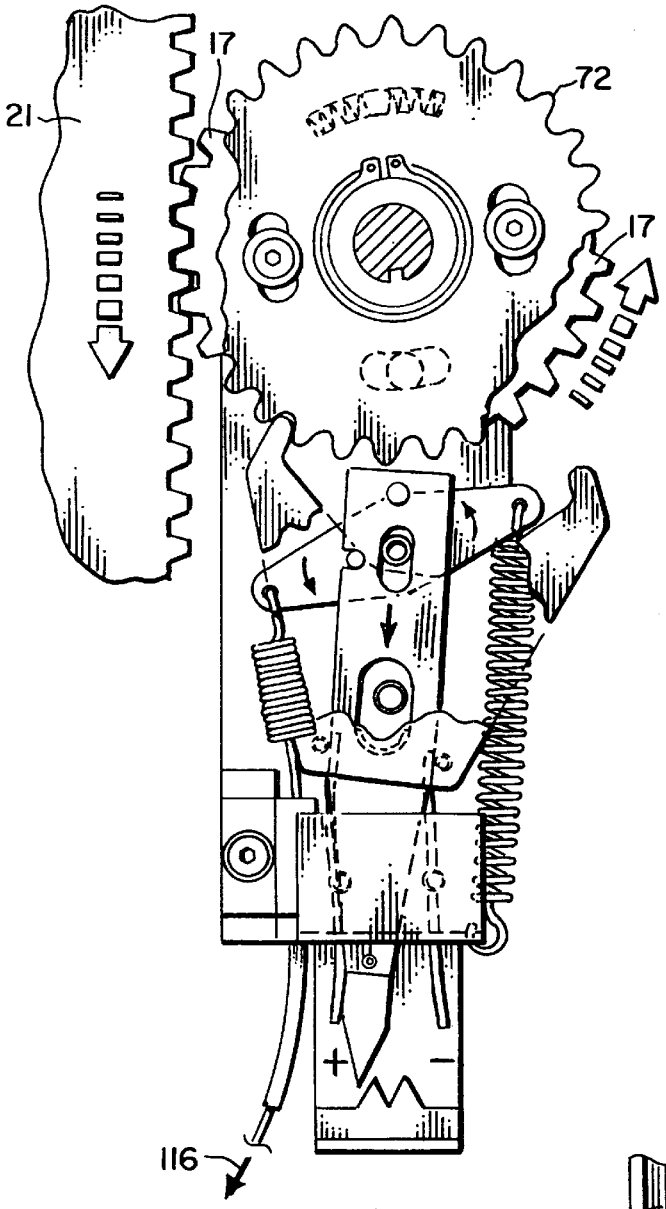
FIG. 9 is another partial elevational view of the preferred embodiment of the apparatus of the present invention shown in an overweight table condition.
Figure 14:
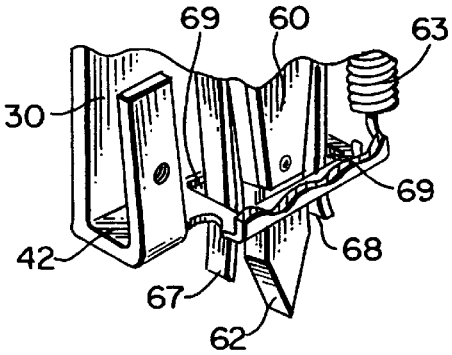
FIG. 14 is a fragmentary perspective view of the preferred embodiment of the apparatus of the present invention showing the load indicator pointer.

In FIGS. 8 and 9, too much weight has been placed on table 22 causing excess weight to be placed on toothed rack 21 of lift 19. This creates a counter clockwise rotation of pinion gear 17 as shown in FIGS. 8 and 9. In FIG. 8, pin 112 rotates with pinion gear 17 as the pinion gear is rotated counter clockwise by rack 21. In FIG. 8, rotation of the pin 112 produces a rotation of locking member 60 about shaft 55 so that pointer 62 indicates that too much weight is on table 22 as indicated by the plus (+) sign in FIG. 8. This rotation of pin 22 and locking member 60 also produces a rotation of yoke 109 about shaft 55. In such an over weight situation, the user must wind spring 15 until the pointer 62 centers on gap 52 indicating a balanced condition.

Yoke 109 is fitted with a pair of spaced apart pins 113, 114 that track the sides of locking members 60 as shown in FIGS. 8, 9, 10 and 11. In an over weight situation such as FIG. 8, rotation of the yoke 109 causes projection 107 to engage the recess in between a pair of spaced apart teeth 110 of brake sprocket 71. The brake sprocket 71 is thus affixed so that it cannot rotate. However, the pinion gear 17 can rotate and does so as indicated by the arrow 115 in FIG. 8. The pinion gear 17 can slowly rotate relative to the brake sprocket 72. However, the plurality of discs 77, 80 prevent rapid rotation of the pinion gear 17 relative to the brake sprocket 72. The area between pinion gear 17 and disc housing cover can be filled with a fluid (eg. silicone). Once the projection 107 of yoke 109 locks to brake sprocket 72, the table top 22 will slowly descend even if the user tries to pull the release paddle as indicated by the arrow 116 in FIG. 9. The yoke 109 remains engaged with brake sprocket 72 because of the torque transmitted from pinion gear 17 to pin 112 to locking member 60.

Figure 10:
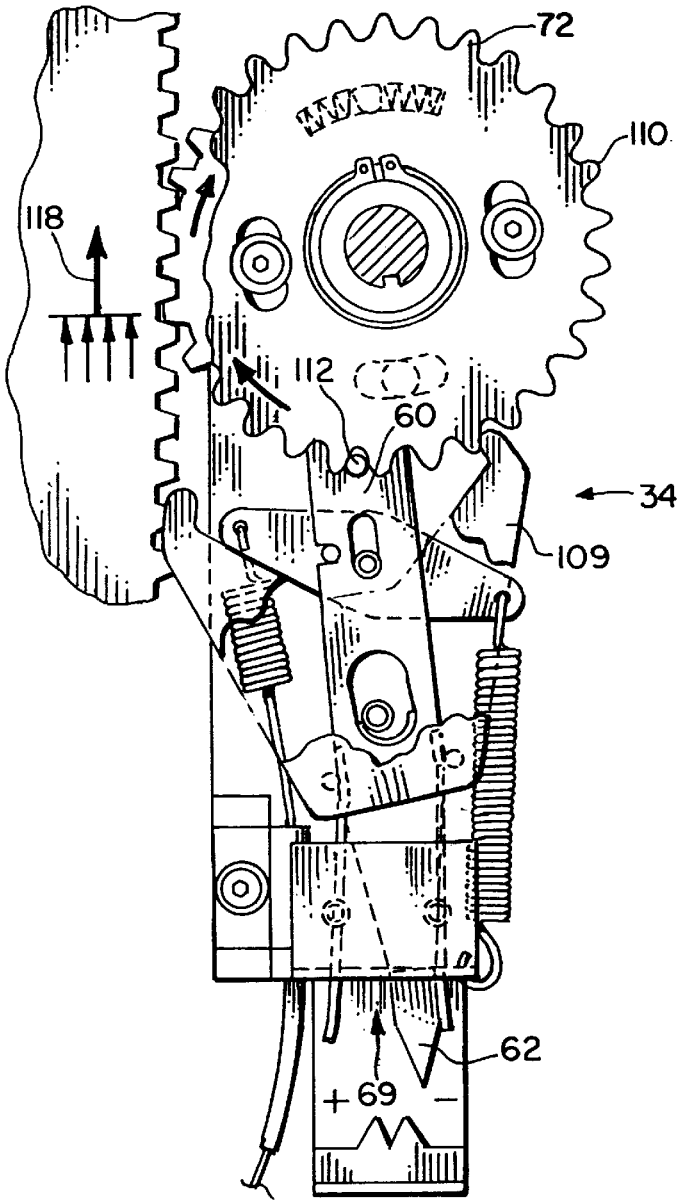
FIG. 10 is a partial elevational view of the preferred embodiment of the apparatus of the present invention showing an over wound counterbalance spring condition.
Figure 15:
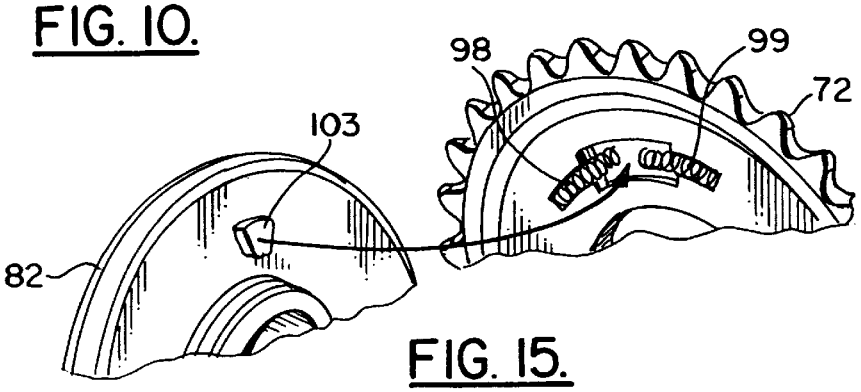
FIG. 15 is a fragmentary perspective view showing the brake sprocket and disc housing cover.
Figure 11:
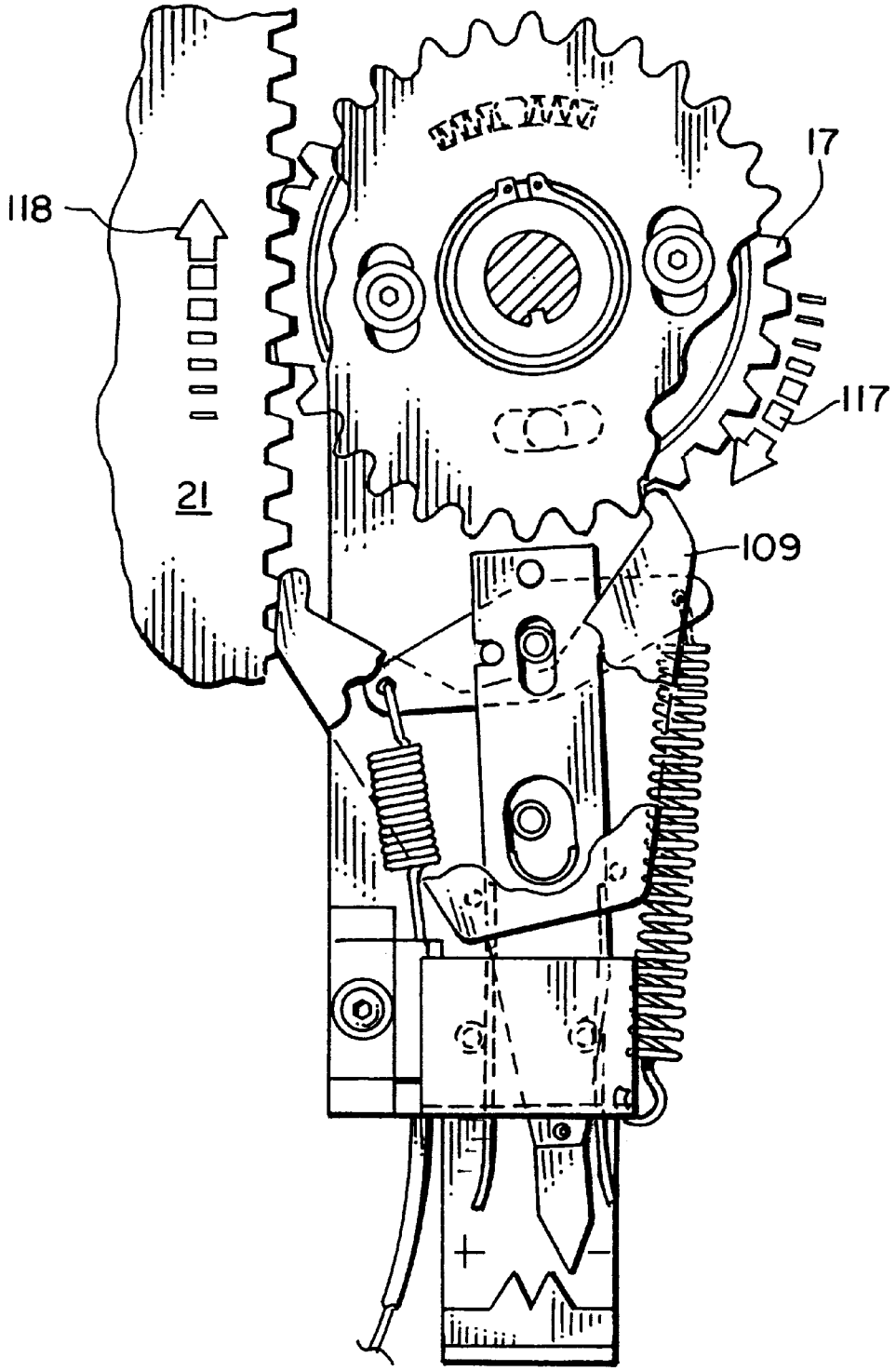
FIG. 11 is a fragmentary perspective view of the preferred embodiment of the apparatus of the present invention showing an over wound counterbalance spring condition.

In FIGS. 10 and 11, the illustration shows an over wound spring condition creating a rotation of pinion gear 17 in a clockwise direction as indicated by arrow 117. In such a situation, the pinion gear 17 is trying to lift rack 21 upwardly in the direction of arrow 118. However, rotation of the pin 112 causes a rotation of locking member 60 and a rotation of yoke 109 so that projection 108 engages the space between adjacent teeth 110 of brake sprocket 72. In such a situation, the table top 22 will gradually ascend in the direction of arrow 118. In this situation wherein spring 15 has been over wound, load indication pointer 62 rotates with locking mechanism 60 so that it points to the minus (–) sign indicating that the spring 15 is over wound and the table top 22 does not have enough weight. The user then unwinds spring 15 until the pointer 62 centers on gap 52 indicating a balanced condition.

Figure 7A:
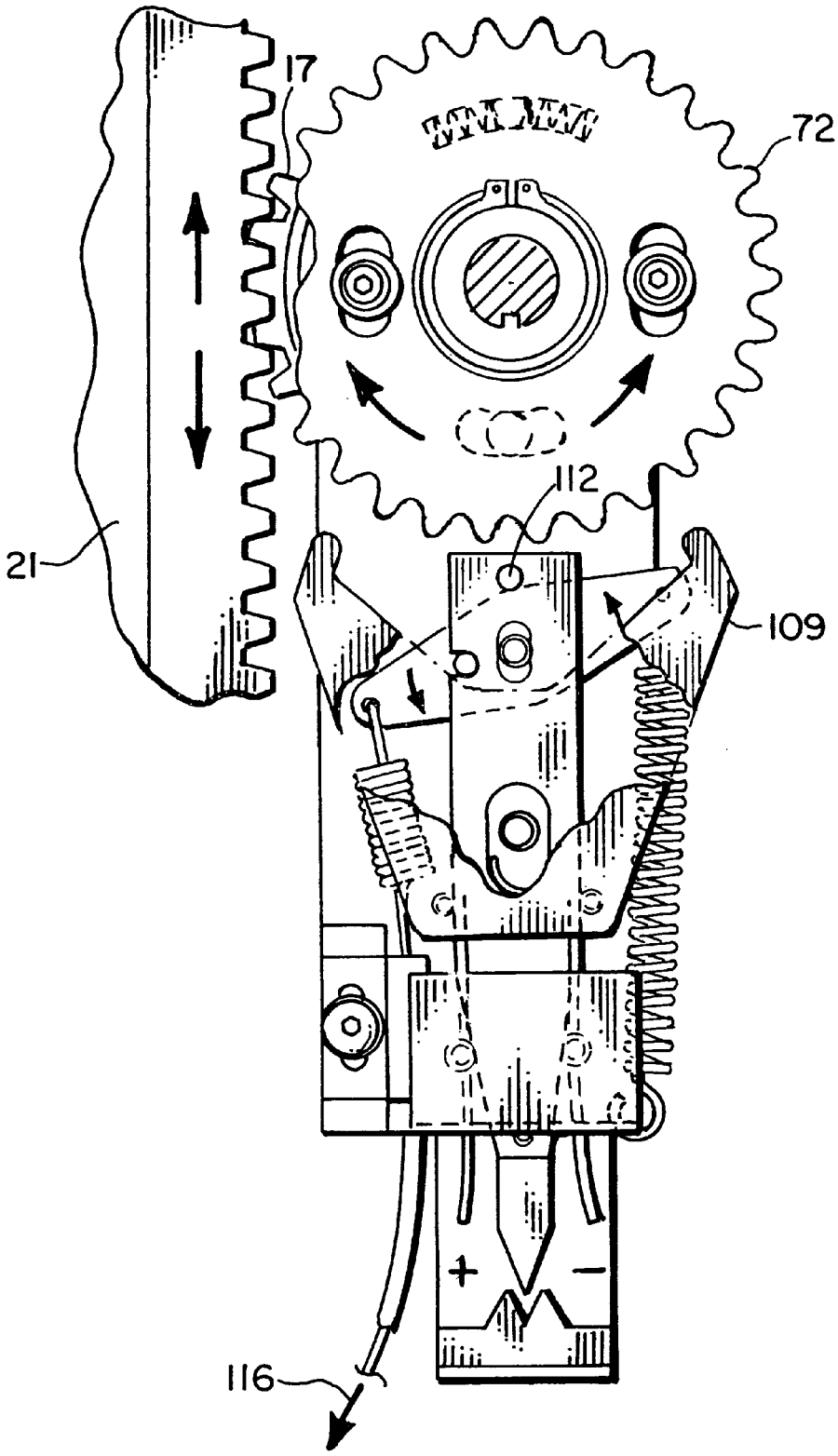

In a situation wherein the spring 15 and load of objects on table top 22 is in balance, the projections 107, 108 of yoke 109 will not be engaged with brake sprocket 72 as shown in FIG. 7. In such a situation, the user is free to depress the release paddle 26 pulling the locking mechanism 60 downwardly to the position shown in FIG. 7A so that the pin 112 is not engaged with either the brake sprocket 72 or the pinion gear 17. In such a situation, the user can freely move the table top 22 upwardly or downwardly to a desired elevational position and then release the paddle 26 so that the pin 112 can engage both pinion gear 17 and brake sprocket 72, producing a locked position as shown in FIG. 7.

The present invention thus provides an improved height adjustable table that enables gradual elevating or gradual descending movement of the table top 22, depending upon whether the user has placed too much weight on the table top 22 or has over wound the spring 15. In either situation, the table top 22 will move very slowly because of the braking produced by the frictionally engaged discs 77–80. It should be understood that a plurality of discs can be provided that is different from the four discs shown in FIGS. 2 and 3.

PARTS LIST

The following is a list of suitable parts and materials for the various elements of the preferred embodiment of the present invention.

| | |
|---|---|
| 10 | adjustable height table |
| 11 | base side |
| 12 | base side |
| 13 | cross member |
| 14 | shaft |
| 15 | counterbalance spring |
| 16 | pinion gear |
| 17 | pinion gear |
| 18 | lift |
| 19 | lift |
| 20 | rack |
| 21 | rack |
| 22 | table top |
| 23 | upper work surface |
| 24 | foot |
| 25 | foot |
| 26 | release paddle |
| 27 | worm gear spring adjuster |
| 28 | shaft |
| 30 | rear plate |
| 31 | front plate |
| 32 | narrow vertical flange |
| 33 | cable support |
| 34 | brake mechanism |
| 35 | slot |
| 36 | cable |
| 37 | sheath |
| 38 | spring |
| 39 | hook |
| 40 | bolt |

-continued

| | |
|---|---|
| 41 | threaded opening |
| 42 | horizontal section |
| 43 | wide vertical flange |
| 44 | threaded opening |
| 45 | bolt |
| 46 | bolt |
| 47 | lower section |
| 48 | load indicator platform |
| 49 | load indicator |
| 50 | projection |
| 51 | projection |
| 52 | gap |
| 53 | opening |
| 54 | shaft |
| 55 | shaft |
| 56 | actuator arm |
| 57 | opening |
| 58 | opening |
| 59 | upper end |
| 60 | locking member |
| 60A | plate |
| 60B | plate |
| 61 | lower end |
| 62 | load indication pointer |
| 63 | spring |
| 64 | cam shaft |
| 65 | upper vertical slot |
| 66 | central opening |
| 67 | leaf spring |
| 68 | leaf spring |
| 69 | lower slot |
| 70 | stop |
| 71 | stop |
| 72 | brake sprocket |
| 73 | splined hub |
| 74 | radial projection |
| 75 | slot |
| 76 | annular groove |
| 77 | disk |
| 78 | disk |
| 79 | disk |
| 80 | disk |
| 81 | annular shoulder |
| 82 | disk housing cover |
| 83 | o-ring |
| 84 | o-ring |
| 85 | peripheral projection |
| 86 | peripheral recess |
| 87 | opening |
| 88 | opening |
| 89 | opening |
| 90 | opening |
| 91 | projection |
| 92 | recess |
| 93 | annular shoulder |
| 94 | flat plate |
| 95 | projection |
| 96 | recess |
| 97 | slot |
| 98 | spring |
| 99 | spring |
| 100 | slot |
| 101 | cylindrical receptacle |
| 102 | opening |
| 103 | projecting portion |
| 104 | projecting portion |
| 105 | recess |
| 106 | recess |
| 107 | projection |
| 108 | projection |
| 109 | yoke |
| 110 | tooth |
| 111 | opening |
| 112 | pin |
| 113 | pin |
| 114 | pin |
| 115 | arrow |
| 116 | arrow |
| 117 | arrow |

-continued

| | |
|---|---|
| 118 | arrow |
| 119 | bolt |

The foregoing embodiments are presented by way of example only; the scope of the present invention is to be limited only by the following claims.

What is claimed is:

1. An adjustable height table comprising:

a) a base that includes spaced apart feet and spaced apart side portions, the side portions each having a cavity;

b) an elevating portion that is mounted on the base, the elevating portion including a table with a work surface and pair of spaced apart lifts that engage the side portions at the respective cavities and elevate upon the respective side portions;

c) an adjustable counterbalance mechanism for aiding a user to raise or lower the elevating portion with respect to the base, the counterbalance mechanism being adjustable to compensate for different weight objects that are placed upon the work surface by the user;

d) a locking mechanism that holds the elevating portion in a fixed position, said locking mechanism including a release for releasing the elevating portion so that it can be elevated or lowered by the user to select a desired elevational position;

e) an indicator that visually displays to the user an indication of whether or not the counterbalance mechanism is balanced with a load placed on the work surface.

2. The adjustable height table of claim 1 wherein the indicator enables the user to determine whether the counterbalance mechanism is under or over balanced for the load placed on the work surface.

3. The adjustable height table of claim 1 wherein the indicator includes a pointer that visually displays an indication of the extent to which the counterbalance mechanism is out of balance.

4. The adjustable height table of claim 1 wherein the indicator is a pointer.

5. The adjustable height table of claim 1 further comprising a brake mechanism that interfaces with the elevating portion of the table base to prevent rapid movement of the elevating portion when the counterbalance mechanism is out of balance.

6. The adjustable height table of claim 5 wherein the brake mechanism includes frictionally engaged disks that rotate in different rotational directions when the elevating portion slowly lowers because of overloading of the work surface.

7. The adjustable height table of claim 5 wherein the brake mechanism has a gear that engages a rack on the elevating portion.

8. The adjustable height table of claim 1 wherein the release includes a cable operated portion.

9. The adjustable height table of claim 1 further comprising a cavity in between the feet that can be occupied by the user's feet and legs during use.

10. An adjustable height table comprising:

a) a base that includes spaced apart feet and spaced apart side portions, the side portions each having a cavity;

b) an elevating portion that is mounted on the base, the elevating portion including a work surface and pair of spaced apart lifts that elevate upon the respective side portions;

c) an adjustable counterbalance mechanism for assisting a user to raise or lower the elevating portion with respect to the base, the counterbalance mechanism being adjustable to compensate for different weight objects that are placed upon the work surface by the user;

d) a locking mechanism that holds the elevating portion in a fixed position, said locking mechanism including a release for releasing the elevating portion so that it can be elevated or lowered by the user to select a desired elevational position;

e) an indicator that indicates to the user whether or not the counterbalance mechanism is in balance with a load placed on the work surface.

11. The adjustable height table of claim 10 wherein the indicator indicates to the user that too much weight is on the work surface.

12. The adjustable height table of claim 10 wherein the indicator indicates to the user that the counterbalance mechanism is over balanced for the weight on the work surface.

13. The adjustable height table of claim 12 wherein the indicator displays an indication of whether the user places too much torque on the counterbalance mechanism.

14. The adjustable height table of claim 10 wherein the indicator includes a pointer.

15. The adjustable height table of claim 10 further comprising a brake that slowly lowers the work surface if the user places excessive weight on the work surface without correspondingly adjusting the counterbalance mechanism.

16. The adjustable height table of claim 15 wherein the brake includes frictionally engaged disks that rotate in different rotational directions when the elevating portion slowly lowers because of overloading of the work surface.

17. The adjustable height table of claim 15 wherein the brake has a gear that engages a rack on the elevating portion.

18. The adjustable height table of claim 10 wherein the release includes a cable operated portion.

19. The adjustable height table of claim 10 further comprising a cavity in between the feet that can be occupied by the user's feet and legs during use.

20. An adjustable height table comprising:

a) a base that includes spaced apart feet and spaced apart side portions;

b) an elevating portion that is mounted on the base, the elevating portion including a work surface and pair of spaced apart lifts that telescopingly engage the side portions, and that elevate upon the respective side portions;

c) an adjustable counterbalance mechanism for aiding a user to raise or lower the elevating portion with respect to the base, the counterbalance mechanism being adjustable to compensate for different weight objects that are placed upon the work surface by the user;

d) a locking mechanism that holds the elevating portion in a fixed position, said locking mechanism including a release for releasing the elevation portion so that it can be elevated or lowered by the user to select a desired elevational position;

e) indicator means for indicating to the user whether the counterbalance mechanism is in balance with a load on the work surface.

21. The adjustable height table of claim 20 further comprising a brake mechanism that interfaces with the elevating portion of the table base to prevent rapid movement of the elevating portion when the counterbalance mechanism is out of balance;

the brake mechanism includes an enclosure that contains a fluid.

22. The adjustable height table of claim 20 further comprising a brake mechanism that interfaces with the elevating portion of the table base to prevent rapid movement of the elevating portion when the counterbalance mechanism is out of balance;

the brake mechanism includes an enclosure that contains a plurality of disks that frictionally engage one another.

23. The adjustable height table of claim 20 further comprising a brake mechanism that interfaces with the elevating portion of the table base to prevent rapid movement of the elevating portion when the counterbalance mechanism is out of balance;

the brake mechanism slowly elevates if the user places too much torque on the counterbalance mechanism.

24. The adjustable height table of claim 20 further comprising a cavity in between the feet that can be occupied by the user's feet and legs during use.

25. An adjustable height table comprising:

a) a base that includes spaced apart feet and spaced apart side portions, the side portions each having a cavity;

b) an elevating portion that is mounted on the base, the elevating portion including a work surface and pair of spaced apart lifts that engage the side portions at the respective cavities and elevate upon the respective side portions;

c) an adjustable counterbalance mechanism for aiding a user to raise or lower the elevating portion with respect to the base, the counterbalance mechanism being adjustable to compensate for different weight objects that are carried by the work surface;

d) a locking mechanism that holds the elevating portion in a fixed position, said locking mechanism including a release for releasing the elevating portion so that it can be elevated or lowered by the user to select a desired elevational position;

e) a brake that slowly elevates the work surface if a user adjusts the counterbalance mechanism to compensate for more weight than is actually carried by the work surface; and f) an indicator that indicates to the user whether or not the counterbalance mechanism is in balance with a load placed on the work surface.

26. The adjustable height table of claim 25 wherein the brake includes an enclosure that contains a fluid.

27. The adjustable height table of claim 25 wherein the brake includes an enclosure that contains a plurality of disks that frictionally engage one another.

28. The adjustable height table of claim 25 wherein the brake slowly elevates if the user places too much torque on the counterbalance mechanism.

29. The adjustable height table of claim 25 further comprising a cavity in between the feet that can be occupied by the user's feet and legs during use.

30. An adjustable height table comprising:

a) a base that includes spaced apart feet and spaced apart side portions;

b) an elevating portion that is mounted on the base, the elevating portion including a work surface and pair of spaced apart lifts that engage the side portions, and that elevate upon the respective side portions;

c) an adjustable counterbalance mechanism for aiding a user to raise or lower the elevating portion with respect to the base, the counterbalance mechanism being adjustable to compensate for different weight objects that are placed upon the work surface by the user;

d) a locking mechanism that holds the elevating portion in a fixed position, said locking mechanism including a release for releasing the elevating portion so that it can be elevated or lowered by the user to select a desired elevational position; and e) a visual display that displays to the user whether or not the counterbalance mechanism is in balance with a load placed on the work surface.

* * * * *